US006679482B2

(12) United States Patent
Allenbaugh

(10) Patent No.: US 6,679,482 B2
(45) Date of Patent: Jan. 20, 2004

(54) CONSTRUCTION PERIMETER GUARD

(75) Inventor: Dwight Allenbaugh, Hays, KS (US)

(73) Assignee: Al Plank & Scaffold Mfg., Inc., Hays, KS (US)

( * ) Notice: Subject to any disclaimer, the term of this patent is extended or adjusted under 35 U.S.C. 154(b) by 16 days.

(21) Appl. No.: 09/946,275

(22) Filed: Sep. 5, 2001

(65) Prior Publication Data

US 2003/0132427 A1 Jul. 17, 2003

(51) Int. Cl.[7] ..... E04G 21/32; E04H 17/14

(52) U.S. Cl. ..... 256/65.14; 256/DIG. 6; 248/231.71; 182/113

(58) Field of Search ..... 256/DIG. 6, 65.06, 256/65.14; 182/113; 248/227.2, 230.6, 231.71

(56) References Cited

U.S. PATENT DOCUMENTS

| | | | | |
|---|---|---|---|---|
| 3,351,311 A | | 11/1967 | Melfi | |
| 3,747,898 A | | 7/1973 | Warren | |
| 3,756,568 A | | 9/1973 | Mocny et al. | |
| 3,863,900 A | | 2/1975 | Dagiel et al. | |
| 3,881,698 A | | 5/1975 | Marsh | |
| 3,938,619 A | | 2/1976 | Kurabayashi et al. | |
| 3,946,992 A | * | 3/1976 | Elias | 256/58 |
| 3,980,278 A | | 9/1976 | Elias | |
| 3,995,833 A | | 12/1976 | McLaughlin et al. | |
| 4,669,577 A | | 6/1987 | Werner | |
| D331,529 S | | 12/1992 | Reinklou | |

FOREIGN PATENT DOCUMENTS

AU PCT/AU92/00582 11/1992

* cited by examiner

*Primary Examiner*—Lynne H. Browne
*Assistant Examiner*—Ernesto Garcia
(74) *Attorney, Agent, or Firm*—Charles H. Thomas

(57) ABSTRACT

The present invention is an improved construction perimeter guard stanchion. A dual adjustment system performs both coarse and fine adjustments to tightly clamp a pair of jaws at the lower end of the stanchion upon the edge of a floor slab in an elevated, unfinished building structure. A coarse jaw adjustment sleeve formed of a short section of hollow steel tubing is coaxially disposed about an outboard support member in sliding engagement therewith. The coarse adjustment sleeve has one or more perforations therethrough so that a locking pin can be passed through it and through aligned openings in the outboard support member. A fine adjustment screw member is disposed coaxially within a vertical rail support tube and may be rotated by lever arms to move the upper jaw closer to or further from the lower jaw. Adjustment of the fine positioning mechanism is performed by manipulating handles at the top of the vertical rail support tube. A workman installing the stanchion thereby does not have to stoop over to operate a clamp located down near the concrete slab.

18 Claims, 5 Drawing Sheets

CONSTRUCTION PERIMETER GUARD

BACKGROUND OF THE INVENTION

1. Field of the Invention

The present invention relates to an assembly for holding guard rails at the peripheral edge of an elevated floor slab during construction of a multifloor building.

2. Description of the Prior Art

In the construction industry commercial, industrial and multiunit residential buildings are typically constructed with a framework formed of steel girders. As the framework for the various floor levels is formed, concrete floor slabs are poured so that the workmen on the project have floor support upon which to perform their tasks. Since the floor slabs are poured before the building walls are constructed it is important to create some type of perimeter guard at the edges of the floor slabs to prevent workmen from inadvertently falling off of the edge of a floor slab without realizing they are near the edge.

For many years perimeter guards for floor slabs in a multistory building have been provided by installing temporary stanchions or posts at spaced intervals around the perimeter of an elevated floor slab. The posts or stanchions are provided with cradles to receive guard rails that provide a temporary fence around the perimeter of the floor slab. This temporary boundary serves to prevent accidental falls until the building walls are constructed.

In conventional systems the installation of perimeter guard posts or stanchions requires an excessive amount of bending, stooping and manipulation of fasteners beyond the outboard edge of a floor slab by the workmen who install the guard posts. Fastening and clamping the fixtures in conventional construction perimeter guard systems require the workmen to perform tasks from awkward, dangerous positions. Also, the components are situated so that the workmen have very poor leverage when tightening the fastening elements of the perimeter guard. As a consequence, installation of a construction area perimeter guard about an elevated floor slab is quite time-consuming and labor-intensive. Furthermore, fasteners are sometimes not tightened correctly due to the poor leverage that the installing workmen are able to exert and also due to fatigue from working in awkward positions.

SUMMARY OF THE INVENTION

The present invention provides an improved construction perimeter guard system. The construction perimeter guard of the present invention employs a plurality of elongated, upright outboard support members each formed of tubular steel having a square or rectangular cross section and having a plurality of pin receiving apertures defined therethrough at spaced vertical intervals. A bottom jaw is secured to the lower extremity of the outboard support member and extends perpendicular thereto laterally inwardly to contact the underside of a concrete slab floor at its edge.

A hollow, coarse adjustment sleeve formed of a short section of tubular steel is disposed in sliding engagement relative to the outboard support member at the lower portion thereof. The coarse jaw adjustment sleeve is formed of a short section of hollow steel tubing having a square or rectangular cross section coaxially disposed about the outboard support member, in sliding engagement therewith. The coarse jaw adjustment sleeve has one or more perforations therethrough so that a locking pin can be passed through it and through aligned openings in the outboard support member.

The coarse adjustment sleeve has a laterally extending connector tube that is secured to a hollow, upright, elongated inboard rail support tube. The rail support tube is provided with at least one rail support cradle. Preferably, the inboard rail support tube has a pair of concave upwardly directed cradles designed to receive horizontally disposed guard rails about the perimeter of the concrete slab floor. The coarse adjustment sleeve is located parallel to and secured alongside the hollow, upright, inboard rail support tube.

A hollow tubular slide is provided with an upper jaw that is oriented perpendicular to the slide and attached to the lower extremity of the slide. Together the slide and upper jaw form an inboard clamp element. The slide fits telescopically within the lower end of the inboard rail support tube. Transversely extending angle sections are secured to the ends of both the upper and lower jaws.

An inner, vertically oriented fine positioning adjustment member is disposed coaxially within the upright, inboard, rail support tube. The lower extremity of the fine positioning adjustment member is secured by a screw connection to the slide, and thereby to the upper jaw. Consequently, rotational movement of the fine positioning adjustment member within the upright rail support tube moves the upper jaw closer to or further from the lower jaw.

The fine adjustment member is formed of an elongated pipe having a short threaded steel rod with an exposed length of about one and a quarter inches at its upper extremity and a longer threaded steel rod with an exposed length of about ten inches at its lower extremity. The two threaded rod sections have left handed threads and are threadably engaged with internal threads in the opposing ends of the pipe. The threaded rods are plug welded to the opposing ends of the pipe to immobilize them relative to the pipe. The pipe and threaded sections are then inserted up into the upright, inboard, rail support tube from the lower extremity thereof. The short, upper steel coupling rod projects through a bearing plate at the top of the upright rail support tube. A butterfly handle is then secured to the upper, short threaded portion of the coupling rod protruding from the top of the rail support tube.

An internally threaded nut is captured between vertically spaced rings that are welded to the inside of the slide near its upper end. The upper end of the slide is inserted up into the lower end of the rail support tube. The lower end of the longer threaded rod section is then screwed into the internally threaded nut located within the slide, thereby drawing the slide telescopically upwardly into the inboard, rail support tube.

To operate the device the upper and lower jaws are first respectively positioned to embrace the upper and lower surfaces of a building floor slab at the slab edge with the jaws as close to each other as possible and as close to the upper and lower surfaces of the concrete slab as possible, as permitted by the spacing of the vertical openings in the sleeve and in the outboard support tube. A coarse adjustment locking pin is then inserted through openings in the opposing walls of the coarse positioning sleeve and through corresponding, longitudinally aligned openings in the outboard support tube encompassed therewithin.

The butterfly handle is then rotated to advance the nut entrapped within the slide downwardly along the length of the lower threaded rod, thereby pushing the slide and upper jaw downwardly. The jaws are thereby clamped against the opposing upper and lower surfaces of the edge of the floor slab to anchor both the outboard support and the inboard rail support tube relative thereto. A plurality of stanchions are installed in this manner at spaced intervals around the perimeter of the floor. The stanchions thereby provide stable support for the transversely extending rails to form a perimeter boundary about the edge of the floor.

One principal advantage of the improved perimeter guard post of the present invention is that the operation of the fine positioning mechanism is performed by manipulating the butterfly handle at the top of the upright, inboard, rail support tube. The workman thereby does not have to stoop over to operate a clamp that is located down near the concrete slab.

In one broad aspect the present invention may be considered to be a perimeter guard rail post. The rail post of the invention is comprised of an outboard clamp element, an inboard support member, a coarse adjustment locking pin, an inboard clamp element and an elongated, fine adjustment member. The outboard clamp element includes a lower, laterally projecting jaw and an upright, elongated outboard support rigidly joined to the lower jaw and having a series of longitudinally spaced locking openings therein.

The inboard support member includes a hollow, inboard rail support tube having opposing upper and lower ends. The inboard rail support tube is provided with at least one rail cradle. The inboard support member also includes a hollow, coarse adjustment sleeve with opposing walls oriented parallel to the rail support tube and rigidly anchored alongside the rail support tube. The coarse adjustment sleeve has at least one set of locking openings therein defined through the opposing walls thereof. The coarse adjustment locking pin passes through the outboard support and the through the coarse adjustment sleeve by releaseable engagement in selected locking openings in the outboard support and the coarse adjustment sleeve.

The inboard clamp element includes a laterally projecting upper jaw and a slide rigidly secured to the upper jaw and extending upwardly therefrom into the lower end of the inboard rail support tube. The slide has an internally tapped member longitudinally immobilized relative thereto.

The elongated, fine adjustment member has opposing upper and lower ends and is disposed within the rail support tube. The fine adjustment member has an externally threaded element at its lower end threadably engaged with the internally tapped member and at least one drive lever at its upper end. The upper end of the rail support tube has a transverse bearing plate with an opening therethrough. The upper end of the fine adjustment member passes through the opening in the bearing plate and is rotatable therewithin. The upper end of the fine adjustment member is longitudinally constrained by the bearing plate. Consequently, rotation of the fine adjustment member by means of the drive lever in opposing directions longitudinally advances and retracts the slide relative to the rail support tube.

Preferably the outboard support, the rail support tube, the coarse adjustment sleeve and the slide are all formed of sections of hollow steel tubing having square cross sections. Also, the internally tapped member of the slide is preferably a nut captured between a pair of abutment rings secured within the slide. In this way the abutment rings restrain the nut from any significant longitudinal movement within the slide, yet allow the nut to be aligned properly for engagement with the fine adjustment member.

The elongated fine adjustment member is preferably comprised of an elongated hollow, cylindrical pipe having opposing internally threaded upper and lower ends and an externally threaded fine adjustment rod having a length at least as great as the distance between the spaced locking openings in the outboard support. The externally threaded fine adjustment rod is threadably engaged in the lower end of the cylindrical pipe and is immobilized from rotation relative thereto, preferably by a weld. The fine adjustment member is further preferably comprised of an externally threaded coupling rod threadably engaged in the upper end of the cylindrical pipe. The coupling rod is also immobilized relative to the pipe, preferably by welding.

The coupling rod extends through the bearing plate and protrudes from the upper end of the rail support tube. The drive lever is preferably formed of a pair of diametrically opposed lever arms or handles and is fastened and rigidly anchored to the coupling rod atop the rail support tube. The pair of diametrically opposed lever arms project radially from the coupling rod. A retaining nut is preferably engaged on and rigidly attached to the coupling rod above the drive lever.

The locking openings in the outboard support are longitudinally spaced no further from each other than about four inches apart and are provided over a distance of at least three feet along the length of the outboard support. The coarse adjustment sleeve preferably includes at least two sets of locking openings or apertures longitudinally spaced apart from each other a distance no greater than about two inches. The upright, rail support tube is preferably at least about three feet long so that a workman manipulating the lever arms located above the upper end of the rail support tube is not required to bend or stoop in order to perform the fine adjustment necessary to secure the perimeter guard rail post to the edge of the floor slab.

The present invention may also be considered to be a perimeter guard stanchion comprising: an outboard clamp element, an inboard support member, at least one locking pin, an inboard clamp element and an elongated fine adjustment member. The outboard clamp element includes an upright, elongated outboard support having a plurality of longitudinally spaced locking apertures defined therein and a laterally projecting lower jaw that is rigidly joined to the lower end of the outboard support. The inboard support member includes a hollow, inboard rail support tube having opposing upper and lower ends and is equipped with at least one rail cradle. A hollow, upright sleeve is oriented parallel to and is located alongside the inboard rail support tube. The upright sleeve has at least one set of locking apertures defined therethrough and is rigidly joined to the inboard rail support. The locking pin is releaseably engageable in at least one selected locking aperture in the outboard support element and in the at least one set of locking apertures in the upright sleeve.

The inboard clamp element includes a laterally projecting upper jaw and a hollow slide rigidly secured to the upper jaw. The slide extends upwardly from the upper jaw in telescopic engagement within the lower end of the rail support tube. An internally tapped member is secured to the hollow slide.

The elongated fine adjustment member has an externally threaded lower end threadably engaged in the internally tapped member and an opposite upper end longitudinally immobilized by the inboard support member. In this way the fine adjustment member is captured by and is rotatable relative to the rail support tube to advance and retract the upper jaw relative to the lower jaw.

The invention may also be considered to be a dual adjustment construction perimeter guard for gripping the edge of an elevated, horizontally disposed slab. The perimeter guard is comprised of an outboard clamp element including a horizontal lower jaw for positioning beneath the edge of the slab and an elongated outboard vertical support member rigidly joined to the lower jaw and projecting upwardly therefrom and defining a plurality of locking apertures therein spaced along its length.

An inboard support member includes an elongated, vertical rail support tube having a lower end and an opposing upper end. The rail support tube has at least one cradle thereon to receive a transverse barrier rail. The upper end of the rail support tube is closed by a transverse end plate with a central aperture therethrough. A hollow vertical sleeve is disposed alongside the lower end of the vertical tube and is rigidly joined thereto. The sleeve receives the outboard vertical support member therewithin and has at least one set of locking apertures defined therethrough. A locking pin projects through the set of locking apertures in the sleeve and through at least one selected, vertically aligned locking aperture in the outboard vertical support member.

An inboard clamp element is provided and includes a horizontal upper jaw for positioning atop the edge of the slab. A hollow, vertical slide tube projects upwardly from the upper jaw telescopically within the lower end of the rail support tube. An internally tapped member is longitudinally immobilized within the vertical slide tube. An elongated fine adjustment screw element is mounted within the vertical rail support tube and has a lower, externally threaded end threadably engaged in the internally tapped member within the vertical slide tube. The fine adjustment screw element also has an upper, externally threaded end projecting upwardly through the central aperture in the transverse end plate of the rail support tube. The upper end of the fine adjustment screw element is longitudinally immobilized relative to the rail support tube. At least one lever arm projects radially from the upper, externally threaded end of the fine adjustment screw for rotating the screw element to advance and retract the slide tube relative to the inboard rail support member.

The invention may be described with greater clarity and particularity by reference to the accompanying drawings.

DESCRIPTION OF THE EMBODIMENT

Figure 1:
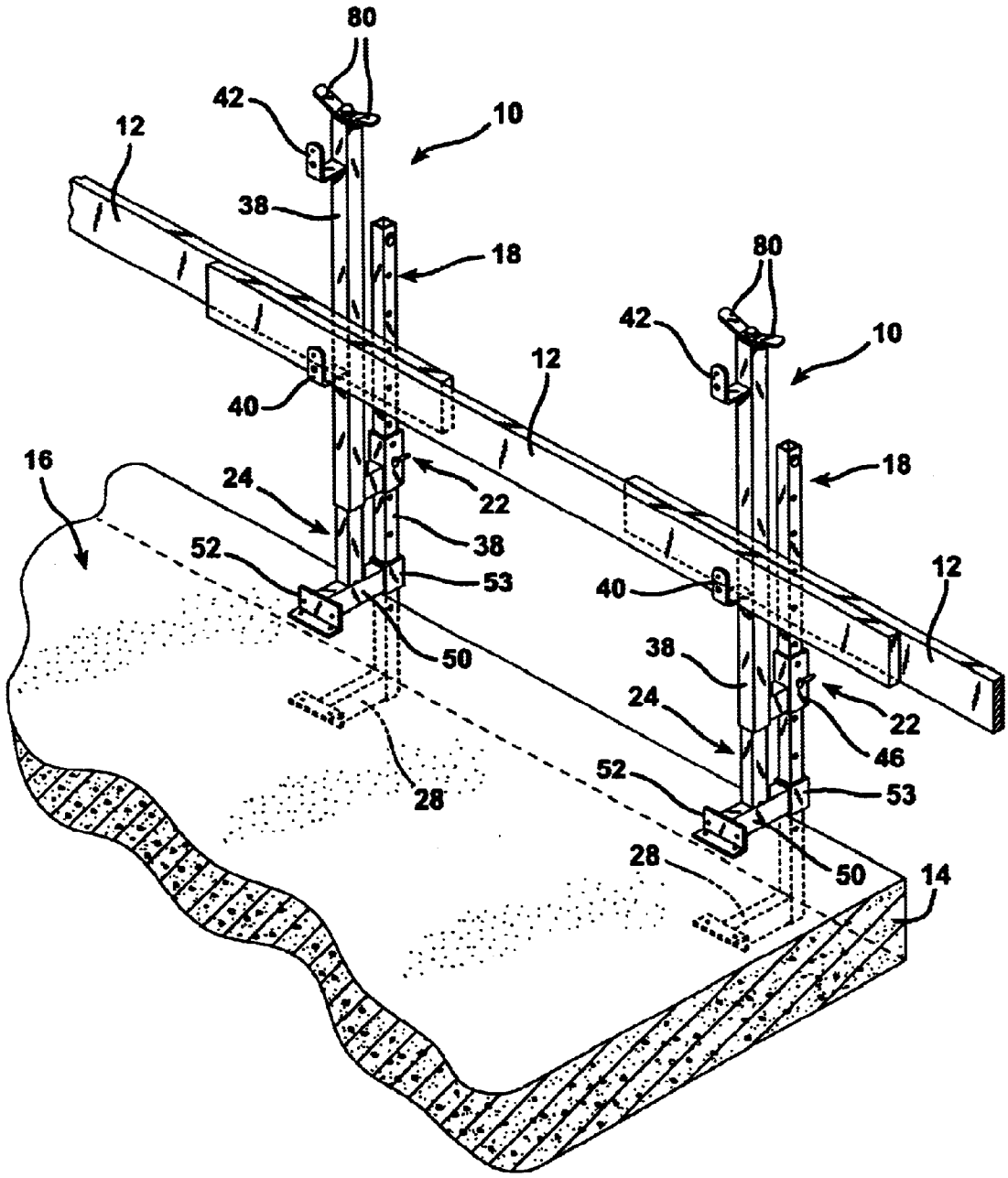
FIG. 1 is a perspective view illustrating a section of a perimeter guard constructed according to the invention.

FIG. 1 illustrates a pair of transversely spaced construction perimeter guard stanchions 10 according to the invention supporting a plurality of transversely extending guard rail boards 12. The stanchions 10 are identical to each other in construction. The perimeter guard stanchions 10 are mounted upon the edge 14 of a concrete floor slab 16. The slab 16 is a typical section of slab flooring poured at a considerable height above grade in the construction of a multistory building.

Figure 2:
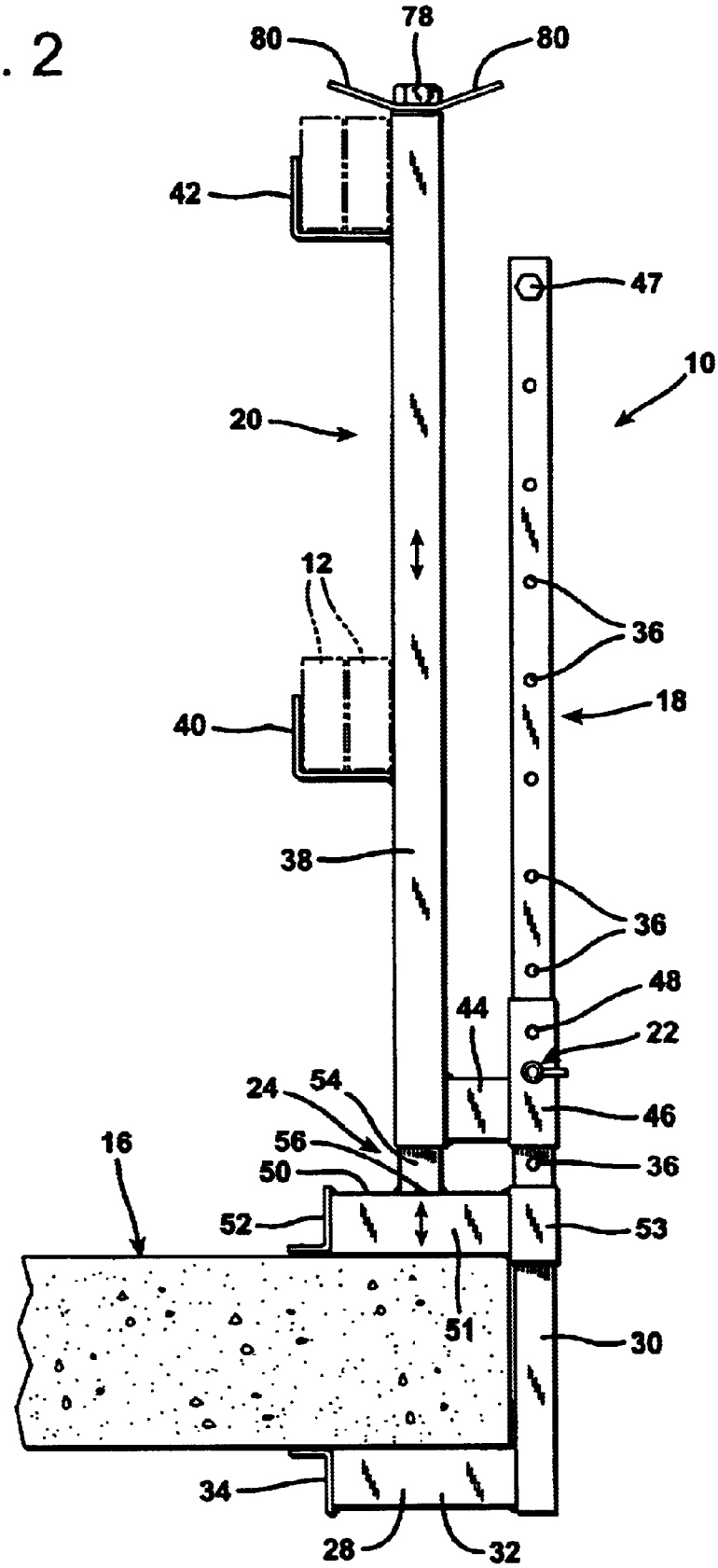
FIG. 2 is a side elevational view illustrating a single perimeter guard stanchion according to the invention.

A single one of the stanchions 10 is illustrated in side elevation in FIG. 2. Each stanchion 10 is comprised of an outboard clamp element 18, an inboard support member 20, at least one locking pin 22, an inboard clamp element 24, and an elongated fine adjustment screw element 26, illustrated in isolation in FIG. 3.

The outboard clamp element 18 includes a horizontal lower, laterally projecting jaw 28 and an outboard vertical support member 30. The lower, laterally projecting jaw 28 is formed of a length of eleven gauge steel tubing 32 with a wall thickness about one-quarter of an inch, and a length of about six and three-quarter inches. The steel tubing 32 forming the lower, laterally projecting jaw 28 has a rectangular cross section. The length of steel tubing 32 preferably has outside cross-sectional dimensions of one and a half inches in width and two and a half inches in height. A length of angle iron 34 is welded across the inboard end of the section of steel tubing 32. The angle iron 34 is preferably four and a half inches long and is formed with a longer vertical leg of two and a half inches and a shorter horizontal leg of one and a half inches. The angle iron section 34 is formed of steel three-sixteenths of an inch thick.

The outboard end of the steel tubing section 32 is welded at right angles to the outboard vertical support member 30 which is formed of 11 gauge steel tubing one and a half inches square and fifty-one inches in length. The opposing walls of the outboard vertical support member 30 are perforated by sets of locking apertures 36 one-quarter of an inch in diameter and spaced four inches apart from each other beginning nine and three-sixteenths inches up from the bottom extremity of the tubing forming the vertical support member 30. There are eleven sets of vertically spaced locking perforations 36, the uppermost of which is located one and three-sixteenths inches from the top of the tubing forming the vertical support member 30.

The inboard support member 20 is formed with an elongated, vertical, hollow, inboard rail support tube 38 formed of 14 gauge steel tubing one and three-quarter inches square and forty-two inches in length. The vertical rail support tube 38 is provided with a pair of rail cradles 40 and 42. The rail cradles 40 and 42 are both L-shaped guard rail holders formed of steel one-quarter of an inch in thickness and one and a half inches in width. The steel stock forming the rail cradles 40 and 42 is bent in half so as to project outwardly from the rail support tube 38 a distance of three and three-quarter inches and upwardly a distance of three and a half inches. The upper rail cradle 42 is joined to the vertical, hollow, inboard rail support tube 38 at a location five and a quarter inches from the upper extremity thereof, while the lower rail cradle 40 is joined to the vertical, hollow, inboard rail support tube 38 at a location twenty-one and seven-eighths inches from the upper extremity thereof.

A horizontal extender 44 is welded to the lower extremity of the vertical, hollow, inboard rail support tube 38. The horizontal extender 44 is formed of a short length of tubular steel of rectangular cross section, having outer dimensions of one and a half inches in width, two and a half inches in height and two and a half inches in length. At its outboard end the extender 44 is welded to a short length of 14 gauge steel tubing one and three-quarter inches square and six inches in length which is oriented as a hollow, vertical coarse adjustment sleeve 46. The vertical coarse adjustment sleeve 46 is parallel to and disposed alongside the lower end of the vertical rail support tube 38. The coarse adjustment sleeve 46 has opposing lateral walls which are perforated by two sets of one-quarter inch diameter locking openings 48 defined therethrough. The two sets of locking openings 48 are preferably spaced from each other a distance of two inches.

The coarse adjustment sleeve 46 may be moved up and down the length of the outboard vertical support 30 to vertically align a selected set of locking aperture openings 48 in the coarse adjustment sleeve 46 with a selected set of locking aperture openings 36 in the outboard vertical support member 30. The locking pin 22 may be inserted through either the upper or lower sets of locking openings 48 in the coarse adjustment sleeve 46. The engagement of the locking pin 22 in the selected sets of locking openings 48 and 36 provides the user with a coarse adjustment appropriate for the thickness of the concrete slab 16 in increments of two inches.

The inboard clamp element 24 includes a horizontal upper jaw 50 formed of a length of eleven gauge steel tubing 51 having a rectangular cross section of one and a half inches in width, two and a half inches in height and six and three-quarter inches in length. At its inboard end the upper jaw 50 is provided with a transverse piece of angle iron 4½ inches in length and three-sixteenths of an inch in thickness. The longer, vertical leg of the length of angle iron 52 is two and a half inches in height, while the shorter, horizontal leg is one and a half inches long. The length of angle iron 52 is welded across the inboard end of the length of steel tubing 51 forming the upper jaw 50.

The inboard clamp element 24 also includes a hollow, vertical slide 54 formed of 12 gauge steel tubing one and a half inches square and eighteen inches in length. A weep hole 56 is punched at the lower end of the slide 54. Another perforation (not visible) is formed through the wall of the slide 54 at a location one and three-quarter inches from its upper extremity. The vertical slide 54 projects upwardly from the upper jaw 50 and fits telescopically within the lower end of the rail support tube 38.

The outboard end of the inboard clamp element 32 has a short length of hollow square tubing welded to the outboard end of the upper jaw 50 to form a guide 53. The guide 53 bits loosely about the outboard vertical support member 30. A bolt 47 at the upper extremity of the outboard vertical support member 30 prevents both the coarse adjustment sleeve 46 and the guide 53 from separating from the outboard clamp element 18.

Figure 4:
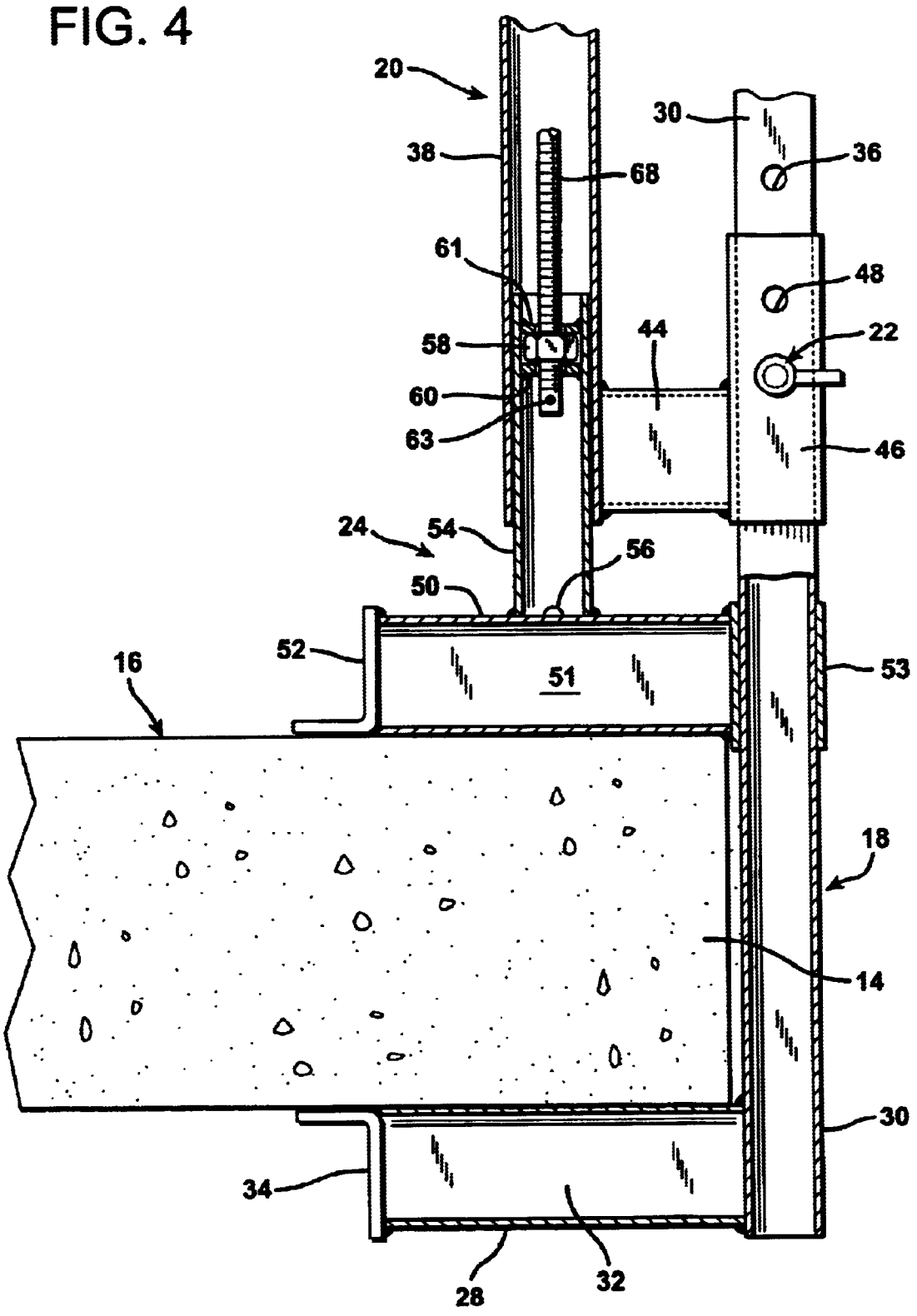
FIG. 4 is a side sectional detail illustrating the jaw of the stanchion of FIG. 2 clamped against the upper and lower surfaces of a concrete floor slab.
Figure 5:
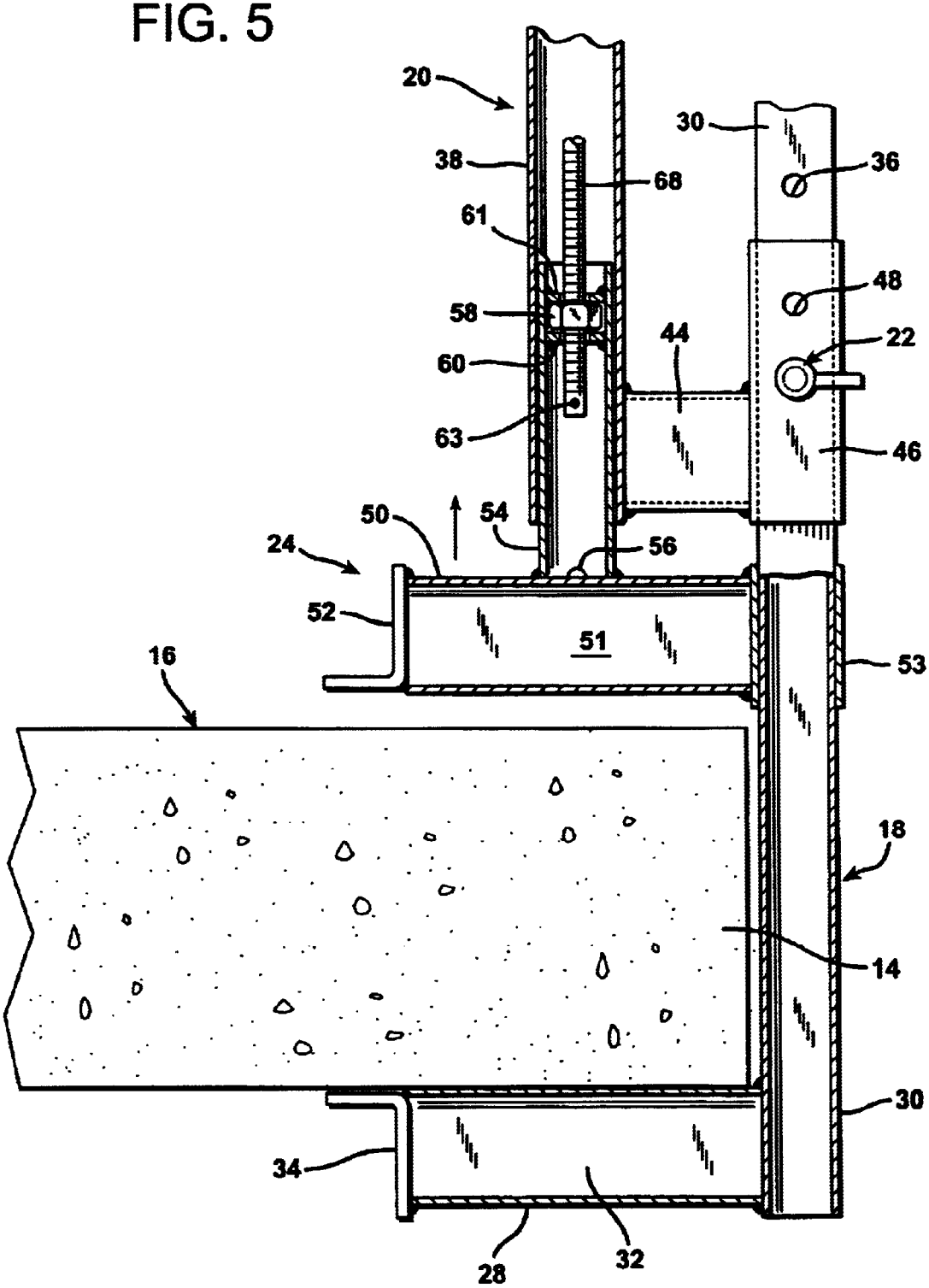
FIG. 5 is a side sectional detail illustrating the upper jaw shown in FIG. 4 withdrawn from contact with the concrete floor slab.

As illustrated in FIGS. 4 and 5, an internally tapped member in the form of a three-quarter inch coil nut 58 is longitudinally immobilized within the vertical slide 54 between a lower twelve gauge steel square washer 60 welded to the interior wall of the slide 54 and an upper, annular disk shaped washer 61 which is one and a quarter inches in diameter and has a central aperture three-eighths of an inch in diameter.

Figure 3:
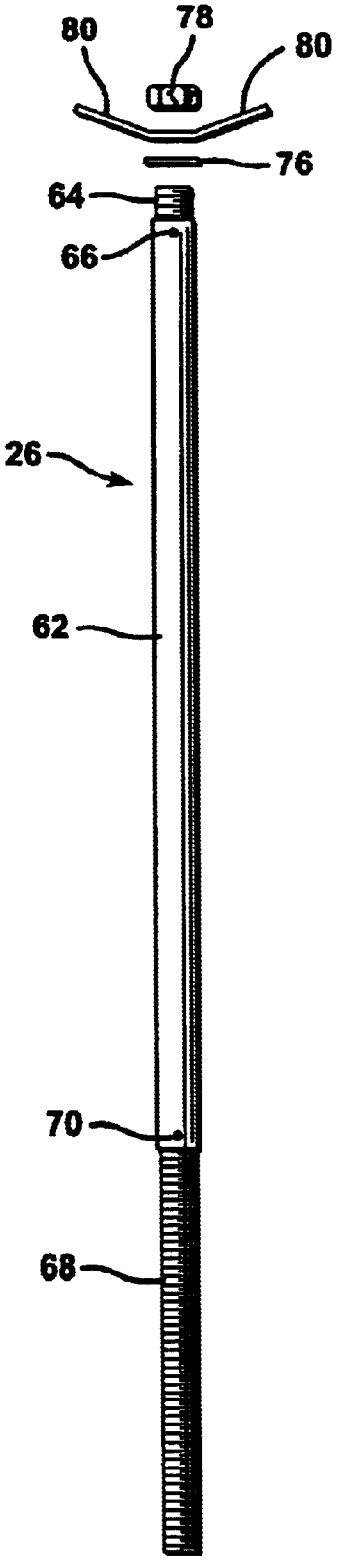
FIG. 3 is a side elevational view illustrating in isolation the fine adjustment member employed in the stanchion shown in FIG. 2.

The elongated fine adjustment screw element 26 is illustrated in isolation in FIG. 3. The fine adjustment screw element 26 is comprised of an elongated length of cylindrical pipe 62 that is one inch in outer diameter and twenty-three and a half inches in length. The length of pipe 62 is internally tapped at both of its ends. A short, externally threaded coupling coil rod 64 is threadably engaged into the upper end of the pipe 62 and is screwed into the pipe 62 a distance of one inch. The coupling rod 64 is three-quarters of an inch in pitch diameter and two and a quarter inches in overall length and is immobilized relative to the pipe 62 by a weld through an opening 66 in the wall of the pipe 62 near its upper extremity. The coupling rod 64 forms the upper end of the fine adjustment screw element 26.

The fine adjustment member 26 is further comprised of a lower, externally threaded three-quarter inch diameter fine adjustment coil rod 68. The fine adjustment rod 68 is at least as long as the distance of spacing between the longitudinally spaced locking apertures 36 in the outboard support member 30, and preferably is considerably longer. The fine adjustment coil rod 68 is preferably eleven and a half inches in overall length in the embodiment of the invention illustrated. The fine adjustment rod 68 is also threadably engaged in the lower end of the pipe 62 a distance of one and a half inches and is immobilized relative thereto by a weld through an aperture 70 near the lower end of the pipe 62. The fine adjustment rod 68 forms the lower end of the fine adjustment member 36.

Figure 6:
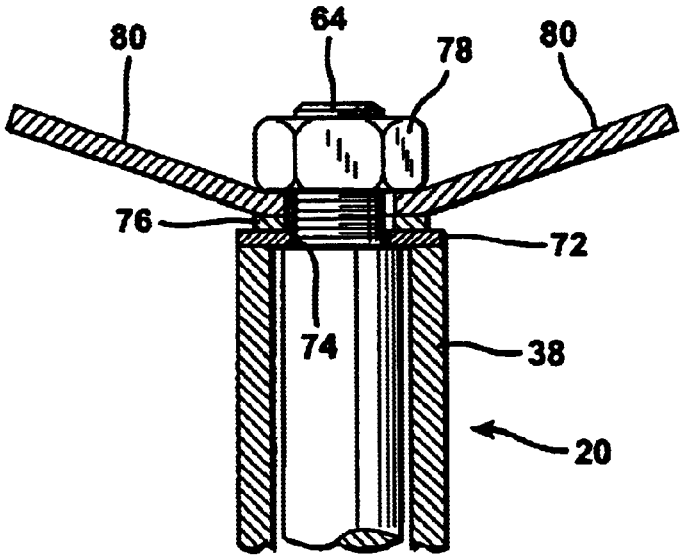
FIG. 6 is a side sectional detail illustrating the interconnection between the upper end of the fine adjustment member and the top of the rail support tube.

As illustrated in FIG. 6, a transverse square bearing plate 72 having a central, axial opening 74 therein is provided at the upper end of the inboard rail support tube 38 and is welded across its top. The central opening 74 through the bearing plate 72 is smaller in diameter than the outer diameter of the cylindrical pipe 62, but is large enough to receive the coupling rod 64 therethrough. This allows the coupling rod 64 to extend upwardly from the upper end of the inboard rail support tube 38 with the threaded upper extremity of the coupling rod 64 protruding above the bearing plate 72.

As shown in FIG. 3, a spacing washer 76 is located atop the bearing plate 72 and a steel bar one-quarter inch in thickness, one and a half inches in width and seven inches in length is center punched with a central three-quarter inch diameter opening midway along its length. A three-quarter inch coil nut 78 is tightly threaded onto the upper tip of the coupling rod 64 and is welded thereto. The ends of the steel bar are each bent up 20 degrees at locations two and three-quarter inches from its longitudinal center to form a pair of lever handles 80. By virtue of the close tolerances and welds formed, all of the elements of the fine adjustment member 26 depicted in FIG. 3 are rigidly joined together so that all of the components of the fine adjustment member 26 rotate as a unit once installed within the vertical rail support tube 38 as shown in FIGS. 4, 5, and 6.

The fine adjustment screw element 26 is coupled to the slide 54 by threadably advancing the fine adjustment coil rod 68 in a worm screw engagement through the nut 58. Once the lower tip of the fine adjustment rod 68 has been advanced below the square washer 60 and at a vertical level even with the opening formed in the wall of the slide 54 (not visible) a weld 63 is formed in the tip of the fine adjustment rod 68 to prevent the fine adjustment rod 68 from being backed out entirely from engagement with the nut 58.

To install a perimeter barrier about the edge 14 of the concrete slab 16 as illustrated in FIG. 1, each of the dual adjustment construction perimeter guard stanchions 10 is installed at the edge 14 of the concrete slab 16 in the manner illustrated in FIGS. 2, 4, and 5. Specifically, the lower and upper laterally projecting jaws 28 and 50 are first separated a sufficient distance from each other so that they can be inserted over the edge 14 of the concrete slab 16 as illustrated in FIG. 5. The lower, laterally projecting jaw 28 is pressed upwardly into contact with the underside of the slab 16 and the upper jaw 50 is moved downwardly as close as possible to the upper surface of the concrete slab 16, as permitted by alignment of a set of the locking openings 48 in the coarse adjustment sleeve 46 with a set of the locking apertures 36 in the outboard vertical support member 30. The locking pin 22 is then inserted through vertically aligned openings 48 and 36 with the upper jaw 50 as close as possible to the upper surface of the concrete slab 16.

The lever arms 80 that extend radially outwardly from the coupling rod 64 in diametrical opposition to each other are then rotated clockwise, as viewed in FIG. 1, so that the worm screw engagement of the fine adjustment rod 68 drives the threaded nut 58 downwardly toward the slab 16. The lever arms 80 serve as a drive lever. Since the nut 58 is entrapped within the slide 54 by the vertically spaced square washer 60 and round washer 61, the slide 54 is forced downwardly from the position depicted in FIG. 5 to the position depicted in FIGS. 2 and 4. The lever handles 80 can be manipulated to perform this fine adjustment by a workman standing atop the upper surface of the concrete slab 16 without bending or stooping. Very typically the final angular rotation of the lever handles 80 is achieved by hammering to rotate the fine adjustment member 26 fully so as to tightly clamp the edge 14 of the concrete slab 16 between the lower, laterally projecting jaw 28 and the upper jaw 50 of each construction perimeter guard stanchion 10. Once all of the stanchions 10 have been erected, as shown in FIG. 1, the wooden perimeter rail boards 12 can be placed in either the rail cradles 40, the rail cradles 42, or in both the rail cradles 40 and 42 about the entire perimeter of the concrete slab 16.

It can be seen that the installation of the perimeter guard stanchions 10 can be achieved without reaching excessively to the outboard side of the slab edge 14 and with a minimum of bending and stooping. The perimeter guard stanchions 10 are thereby far easier to install than conventional construction perimeter guard stanchions.

Undoubtedly, numerous variations and modifications of the invention will become readily apparent to those familiar with construction scaffolding and safety equipment. For example, a flat plate with an internally tapped aperture therethrough may be welded atop the slide 54 to engage the fine adjustment coil rod 68 in place of the nut 58. Also, the elongated outboard support could be formed as a solid bar, rather than as a tubular structure. In addition, the coil rods 64 and 68 can be immobilized relative to the pipe 62 by lock nuts or some means other than welding. Accordingly, the scope of the invention should not be construed as limited to this specific embodiment depicted and described, but rather is defined in the claims appended hereto.

I claim:

1. A perimeter guard rail post comprising:

an outboard clamp element including a lower, laterally projecting jaw and an upright, elongated outboard support rigidly joined to said lower jaw and having a series of longitudinally spaced locking openings therein, an inboard support member including a hollow, inboard rail support tube having opposing upper and lower ends and provided with at least one rail cradle, and a hollow coarse adjustment sleeve with opposing walls oriented parallel to said rail support tube and rigidly anchored alongside said rail support tube, and said coarse adjustment sleeve has at least one set of locking openings defined through sail opposing walls thereof, a coarse adjustment locking pin that passes through said outboard support and through said coarse adjustment sleeve by releaseable engagement in the selected locking openings in said outboard support and said coarse adjustment sleeve, an inboard clamp element including a laterally projecting upper jaw and a slide rigidly secured to said upper jaw and extending upwardly therefrom into said lower end of said inboard rail support tube, and said slide has an internally tapped member longitudinally immobilized relative thereto, wherein said internally tapped member of said slide is a nut captured between a pair of abutment rings secured within said slide, whereby said abutment rings restrain said nut from longitudinal movement within said slide, and an elongated fine adjustment member having opposing upper and lower ends and disposed within said rail support tube, and said fine adjustment member has an externally threaded element at the lower end threadably engaged with said internally tapped member and a drive lever at the upper end of said fine adjustment member, and said rail support tube has a transverse bearing plate with an opening therethrough and said upper end of said fine adjustment member passes through said opening in said bearing plate and is rotatable therewithin and longitudinally constrained by said bearing plate, whereby rotation of said drive lever in opposing directions longitudinally advances and retracts said slide relative to said rail support tube.

2. A perimeter guard rail post according to claim 1 wherein said outboard support, said rail support tube, said coarse adjustment sleeve and said slide are all formed of sections of steel tubing having square cross sections.

3. A perimeter guard rail post according to claim 1 wherein said elongated fine adjustment member is comprised of an elongated, hollow, cylindrical pipe having opposing internally threaded upper and lower ends and an externally threaded fine adjustment rod having a length at least as great as the distance between said spaced locking openings in said outboard support, and said externally threaded fine adjustment rod is threadably engaged in said lower end of said cylindrical pipe and is immobilized from rotation relative thereto.

4. A perimeter guard rail post according to claim 3 wherein said elongated fine adjustment member is further comprised of an externally threaded coupling rod threadably engaged in said upper end of said cylindrical pipe and said coupling rod extends through said bearing plate and protrudes from said upper end of said rail support tube, and said drive lever is fastened to said coupling rod atop said rail support tube.

5. A perimeter guard rail post according to claim 4 wherein said drive lever is comprised of a pair of diametrically opposed lever arms projecting radially from said coupling rod, and a retaining nut is threadably engaged on said coupling rod above said drive lever and said retaining nut is rigidly fastened to said coupling rod.

6. A perimeter guard rail post according to claim 1 wherein said locking openings in said outboard support are longitudinally spaced at about four inch intervals.

7. A perimeter guard rail post according to claim 6 wherein said coarse adjustment sleeve includes at least two sets of locking openings longitudinally spaced about two inches apart.

8. A perimeter guard rail post according to claim 1 wherein said rail support tube is at least three feet long.

9. A perimeter guard stanchion comprising:

an outboard clamp element including an upright, elongated outboard support having a plurality of longitudinally spaced locking apertures defined therein and a laterally projecting lower jaw that is rigidly joined to a lower end of said outboard support, an inboard support member including a hollow inboard rail support tube having opposing upper and lower ends and equipped with at least one rail cradle, and a hollow upright sleeve oriented parallel to and located alongside said inboard rail support tube, and said upright sleeve has at least one set of locking apertures defined therethrough and is rigidly joined to said inboard rail support tube, at least one locking pin releaseably engageable in at least one of the locking apertures in said outboard support and in said at least one set of locking apertures in said upright sleeve, and inboard clamp element including a laterally projecting upper jaw and a hollow slide rigidly secured to said upper jaw and extending upwardly therefrom in telescopic engagement within said lower end of said rail support tube, and an internally tapped member secured to said hollow slide, an elongated fine adjustment member located within said rail support tube and having an externally threaded lower end threadably engaged in said internally tapped member and an opposite upper end longitudinally immobilized by said inboard support member, wherein said fine adjustment member is comprised of an elongated cylindrical pipe with internally threaded upper and lower ends, and an externally threaded fine adjustment rod threadably engaged in said lower end of said pipe and anchored thereto to form said lower end of said fine adjustment member, whereby said fine adjustment member is captured by and is rotatable relative to said rail support tube to advance and retract said upper jaw relative to said lower jaw.

10. A perimeter guard stanchion according to claim 9 wherein said fine adjustment rod is at least as long as the distance between said longitudinally spaced locking apertures in said outboard support.

11. A perimeter guard stanchion according to claim 9 wherein said fine adjustment member is further comprised of an externally threaded coupling rod threadably engaged in said upper end of said pipe, and a transverse bearing plate is provided at said upper end of said inboard rail support tube and said bearing plate has a central, circular opening therethrough smaller in diameter than the outer diameter of said cylindrical pipe and large enough to receive said coupling rod therethrough, whereby said coupling rod extends upwardly from said upper end of said inboard rail support tube.

12. A perimeter guard stanchion according to claim 11 wherein said fine adjustment member is further comprised of a pair of diametrically opposed lever arms projecting radially outwardly from said coupling rod and anchored thereto above said bearing plate.

13. A perimeter guard stanchion according to claim 9 wherein said locking apertures in said outboard support are spaced no further from each other longitudinally than about four inches apart and are provided over a distance of at least three feet along the length of said outboard support.

14. A perimeter guard stanchion according to claim 13 wherein said upright sleeve has at least two sets of locking apertures longitudinally spaced apart from each other a distance no greater than about two inches.

15. A perimeter guard stanchion according to claim 9 wherein said fine adjustment member is provided with at least one torque lever at said upper end thereof and above said upper end of said rail support tube.

16. A perimeter guard stanchion according to claim 15 wherein said elongated fine adjustment member is further comprised of an elongated pipe and said upper and lower ends of said fine adjustment member are formed of lengths of externally threaded rods threadably engaged in opposing ends of said pipe and immobilized relative thereto.

17. A dual adjustment construction perimeter guard for gripping the edge of an elevated, horizontally disposed slab, comprising:

and outboard clamp element including a horizontal lower jaw for positioning beneath said edge of said slab and an elongated outboard vertical support member rigidly joined to said lower jaw and projecting upwardly therefrom and defining a plurality of vertically aligned locking apertures therein spaced along its length, and inboard support member including an elongated, vertical rail support tube having a lower end and an opposing upper end and having at least one cradle thereon to receive a transverse barrier rail, and said upper end is closed by a transverse end plate with a central aperture therethrough, and a hollow vertical sleeve is disposed alongside said lower end of said vertical rail support tube and is rigidly joined thereto, wherein said sleeve receives said outboard vertical support member therewithin and has at least one set of locking apertures defined therethrough, a locking pin projecting through said set of locking apertures in said sleeve and through at least one said locking aperture in said outboard vertical support member, an inboard clamp element including a horizontal upper jaw for positioning atop said edge of said slab, and a hollow, vertical slide tube projecting upwardly from said upper jaw telescopically within said lower end of said rail support tube, and an internally tapped member longitudinally constrained within said vertical slide tube, and an elongated fine adjustment screw element formed of an elongated pipe, internally threaded at both of its ends, and externally threaded upper and lower steel rods engaged in both ends of said pipe and said elongated fine adjustment screw element is mounted within said vertical rail support tube and said lower steel rod has an externally threaded end threadably engaged in said internally tapped member within said vertical slide tube and an said upper steel rod has an externally threaded end projecting upwardly through said central aperture in said transverse end plate of said rail support tube and longitudinally immobilized relative thereto, and at least one lever arm projecting radially from said upper, externally threaded end of said fine adjustment screw element for rotating said screw element to advance and retract said slide tube relative to said inboard rail support tube.

18. A dual adjustment construction perimeter guard according to claim 17 wherein said outboard vertical support member, said rail support tube, said sleeve and said slide are all formed of steel tubing having square cross sections.

* * * * *